US006676389B2

(12) United States Patent
Bartsch

(10) Patent No.: US 6,676,389 B2
(45) Date of Patent: Jan. 13, 2004

(54) PISTON PUMP FOR INCREASING PRESSURE, COMPRISING A TRANSFER PISTON AND A PRESSURE-CONTROL PISTON

(75) Inventor: Guenter Bartsch, Zuelpich (DE)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 10/063,169

(22) Filed: Mar. 27, 2002

(65) Prior Publication Data

US 2002/0146337 A1 Oct. 10, 2002

(30) Foreign Application Priority Data

Apr. 7, 2001 (EP) ..... 01108795

(51) Int. Cl.[7] ..... F04B 37/00

(52) U.S. Cl. ..... 417/470; 417/549; 417/307; 417/284; 123/90.17; 123/508

(58) Field of Search ..... 417/470, 549, 417/440, 307, 284; 123/90.17, 90.15, 508, 196 R, 196 M

(56) References Cited

U.S. PATENT DOCUMENTS

| | | | | |
|---|---|---|---|---|
| RE28,880 | E | * 6/1976 | Farrow | 101/366 |
| 6,332,438 | B1 | * 12/2001 | Machida | 123/90.15 |
| 6,474,963 | B1 | * 11/2002 | Wetzel et al. | 417/549 |
| 6,477,996 | B2 | * 11/2002 | Ogawa | 123/90.15 |
| 2002/0056427 | A1 | * 5/2002 | Lee | 123/90.17 |

FOREIGN PATENT DOCUMENTS

| | | |
|---|---|---|
| EP | 1046793 | 3/2000 |

* cited by examiner

*Primary Examiner*—Cheryl J. Tyler
*Assistant Examiner*—Emmanuel Sayoc
(74) *Attorney, Agent, or Firm*—Julia Voutyras; Daly, Crowley & Mofford, L.L.P.

(57) ABSTRACT

The invention relates to a piston pump for increasing pressure for liquids, in particular for the camshaft phase adjustment of reciprocating internal combustion engines, said piston pump advantageously being integrated into the housing of the cylinder head. The piston pump for increasing pressure is defined in that it increases an existing fluid pressure to a required fluid pressure and keeps this pressure virtually constant. The piston pump for increasing pressure is advantageously pre-assembled in a sleeve.

7 Claims, 1 Drawing Sheet

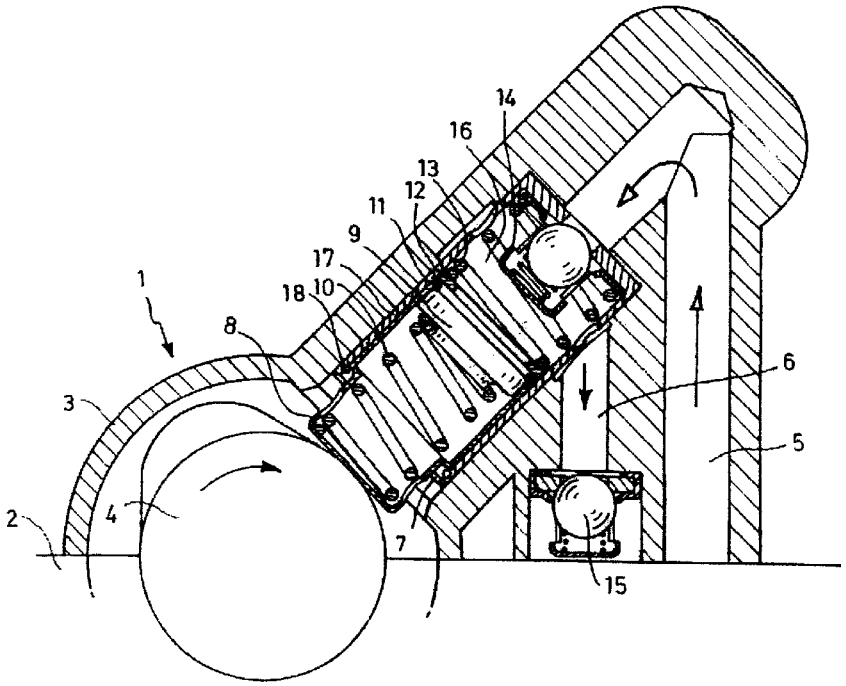
1
2
3
4
5
6
7
8
9
10
11
12
13
14
15
16
17
18

PISTON PUMP FOR INCREASING PRESSURE, COMPRISING A TRANSFER PISTON AND A PRESSURE-CONTROL PISTON

BACKGROUND OF INVENTION

The present invention relates to a piston pump containing a delivery piston, a pressure-limiting piston, a restoring spring, a pressure-controlling spring and two non return valves, which is preferably suitable for ensuring a sufficient hydraulic pressure for actuating a variable valve timing gear in internal combustion engines.

A variable valve timing gear for internal combustion engines is disclosed in EP 1 046 793. In this case, the stream of lubricant produced by the existing lubricant pump is used to actuate an adjusting device situated between the impeller and camshaft at the end of the camshaft, said adjusting device in turn causing a phase displacement of the camshaft. The abovementioned adjusting devices are supplied as a rule through holes in the camshaft, the stream of lubricant generally being controlled by solenoid valves.

However, at low engine speeds, even when the quantity of lubricant is sufficient, the pressure of the lubricant may be too low to actuate the adjusting devices, or else the actuation takes place too slowly. Typically, a lubricant pump having increased delivery capacity has been installed in order to compensate for this known drawback. However, at relatively engine high speeds the pump consumes a lot of power, which is undesirable, since it reduces engine efficiency. As an alternative, two-stage pumps or variable pumps are used which ensure a sufficient lubricant pressure at low speeds, but do not have such high power consumption at high speeds. However, these pumps are very cost-intensive.

A pump of the type mentioned at the beginning is disclosed in EP 0 976 926. It is used to deliver a fluid medium, for example fuel, and/or to increase the pressure. For this purpose, a piston which can move up and down in a cylindrical hole is driven by a cam directly or by means of a tappet push rod. During the upward movement of the piston the fluid flows through the outlet passage, while at the same time fluid passes onto the second side of the piston through a non-return valve. The downward movement of the piston allows the fluid to flow, while the first-mentioned non-return valve closes, through a second non-return valve into the cylinder.

The inventors herein have recognized that this type of pump also reaches very high liquid pressures, and therefore reduces engine efficiency.

SUMMARY OF INVENTION

Against this background, the present invention teaches a pressure-increasing pump that ensures an approximately uniform liquid pressure and at the same time avoids the disadvantages of the prior art.

In carrying out the features and advantages of the present invention, pump comprising a housing; a transfer piston slidably positioned in said housing; a pressure-controlling piston slidably positioned in said transfer piston; and an energy-accumulating device controlling movement of said pressure-controlling piston within said transfer piston, said movement of said pressure-controlling piston providing an essentially uniform fluid pressure within said housing is presented.

The cylinder head of an internal combustion engine contains at least one camshaft, which is provided with a known variable valve timing device. In the advantageous embodiment shown here, the cylinder head contains a housing in which the individual parts of the pressure-increasing pump are accommodated. This housing can be an integral part of the cylinder head or can be appropriately fitted as a separate part. Situated in the housing is a transfer piston which is driven in a known manner, directly or by means of a tappet, by a cam, already present, of the engine valve timing gear, or, advantageously, by an additional cam situated on the camshaft. In an advantageous embodiment, the transfer piston is designed as a hollow part having a fluid-outlet and pressure-equalizing hole lying transversely at the cam-side end. The transfer piston is closed on the cam side and bears against the camshaft, while the opposite end is open. The open end of the transfer piston is closed by the pressure-controlling piston, which, for its part, is pressed by the pressure-controlling spring against a snap ring that is embedded in a groove in the transfer piston. Further components of the pump also include a compression spring, which guides the transfer piston frictionally on the cam in a known manner, and one to two non-return valves. In this case, the non-return valve, which, in an advantageous embodiment is held by the compression spring, opens during the intake stroke to the inlet passage, integrated into the housing, while the second non-return valve, which is fitted laterally here, releases liquid into the delivery passage when the desired delivery pressure is reached.

An advantage of the present invention resides in the fact that all the parts belonging to the pressure-increasing pump are pre-assembled in an insert, so that simple assembly of the pump is possible.

The above advantages and other advantages, objects and features of the present invention will be readily apparent from the following detailed description of the preferred embodiments when taken in connection with the accompanying drawings.

BRIEF DESCRIPTION OF DRAWINGS

The objects and advantages described herein will be more fully understood by reading an example of an embodiment in which the invention is used to advantage, referred to herein as the Description of Preferred Embodiment, with reference to the drawings, wherein:

FIG. 1 shows a schematic vertical section through a cylinder head of a motor vehicle having the pressure-increasing pump according to the invention.

DETAILED DESCRIPTION

As will be appreciated by those of ordinary skill in the art, the present invention is independent of the particular underlying engine technology and configuration. As such, the present invention may be used in a variety of types of internal combustion engines, such as conventional engines, in addition to direct injection stratified charge (DISC) or direct injection spark ignition engines (DISI).

In FIG. 1, a piston pump 1 according to the invention is illustrated in vertical section. It can be seen that the piston pump 1 is fitted into a housing 3 which is connected in turn to the cylinder head 2 of an internal combustion engine. A camshaft 4, which is mounted in a known manner in the cylinder head 3, is also shown.

The housing 3 contains an inlet passage 5, which is acted upon by lubricant in a known manner during operation of a reciprocating internal combustion engine, an outlet passage or delivery passage 6 and a hole 7 which accommodates the individual parts of the pressure-increasing pump or a sleeve 17 (containing the pressure-increasing pump, shown here).

In the hole 7, or as shown here, in the sleeve 17, a transfer piston 8 is mounted in a displaceable manner, a pressure-controlling piston 9, which is likewise mounted in a displaceable manner, and a pressure-controlling spring 10, both held by a snap ring 11, being arranged in the transfer piston 8. However, the pressure-controlling spring 10, shown here, can also be any other type of energy accumulator that satisfies the function.

The transfer piston 8 in turn is pressed by a second compression spring 13 via a washer 12 onto the cam of the camshaft 4, so that a continuous, frictional contact between the transfer piston and cam is ensured. On the other hand, the spring strength of the compression spring is to be selected to be as small as possible in order to keep the required driving power of the pump small. In the version shown here, the compression spring 13 additionally holds a non-return valve 14 in position. In addition, a second non-return valve 15 is situated in the housing. The non-return valve 14 serves to let the lubricant into a displacement space 16, while the non-return valve 15 is provided as an outlet valve.

In the advantageous embodiment of the invention which is shown here, the transfer piston 8 (containing the pressure-controlling spring 10 and the pressure-controlling piston 9 secured by the snap ring 11), the washer 12, the compression spring 13 and the inlet non return valve 14 are fitted in a sleeve 17 and secured by a second snap ring 18, the sleeve 17 being open on the camshaft side in order to receive the transfer piston 8 and on the lubricant inlet side having a hole of sufficient size in order to fill the pump through the inlet non-return valve 14.

During operation of an internal combustion engine the existing lubricant pump delivers lubricant into the inlet passage 5 of the pressure-increasing pump. The lubricant passes through the non return valve 14 into the displacement space 16 formed by the space between the transfer piston 8, hole 7, the inlet non-return valve 14 and the outlet non return valve 15. If the camshaft 4 rotates from the position shown in FIG. 1 through 90° in the direction of rotation marked by the arrow, the transfer piston 8 is pressed in the hole 7 or in the sleeve 17 in the direction of the inlet passage 5. At the same time, the inlet non-return valve 14 closes. By means of the movement of the piston, the fluid is displaced and thereby conveyed through the outlet passage 6 and the outlet non-return valve 15 to the consumer or consumers (camshaft adjusting device).

According to the invention, the output pressure is not to exceed a certain desired value. This value is determined by the stiffness of the pressure-controlling spring and of the surface of the pressure-controlling piston. If the desired output pressure is reached during the cam stroke, the pressure-controlling spring is compressed and a further pressure increase does not take place.

In the event of the input pressure already lying at the level of the desired output pressure or, if no fluid is required by the consumer or consumers, the pump delivers virtually no fluid. The pressure-controlling piston remains in one position and the camshaft operates only against the pressure-controlling spring.

If the delivery pressure of the lubricant by the standard feedpump of a reciprocating internal combustion engine should exceed the desired pressure for the camshaft adjusting device, an additional pressure control valve (not shown here) can possibly also be provided either in the inlet passage 5 or in the delivery passage 6.

If the camshaft rotates further to the 180° position, the transfer piston 8 and the pressure-controlling piston 9 move in a frictional manner guided by the compression spring 13 in the direction of the camshaft 4 and increase the displacement space 16. This produces a suction pressure that opens the valve 14 and closes the valve 15.

If the camshaft moves further to 360°, the next pumping cycle begins.

The invention therefore shows a device for increasing pressure in fluids, which device can be placed with little outlay on material and extremely little outlay on installation into virtually all common housings of the abovementioned type in order there to increase the pressure supply of the camshaft adjusting device in a manner which meets requirements.

This concludes the description of the invention. The reading of it by those skilled in the art would bring to mind many alterations and modifications without departing from the spirit and the scope of the invention. Accordingly, it is intended that the scope of the invention be defined by the following claims:

What is claimed is:

1. A pump comprising:

a housing;

a transfer piston slidably positioned in said housing;

a pressure-controlling piston slidably positioned in said transfer piston: and an energy-accumulating device controlling movement of said pressure-controlling piston within said transfer piston, said movement of said pressure-controlling piston providing an essentially uniform fluid pressure within said housing; and wherein said housing is coupled to a cylinder head of an internal combustion engine of a vehicle having a variable valve timing device, said pump supplying a fluid to said variable valve timing device.

2. The housing as claimed in claim 1 further comprising an inlet valve and an outlet valve.

3. The pump as set forth in claim 1 wherein said energy-accumulating device is a spring.

4. An apparatus for supplying a lubricant to a variable valve timing device coupled to a camshaft in an internal combustion engine having at least one cylinder head, the apparatus comprising:

a pump housed in the cylinder head, comprising:

a housing;

a transfer piston slidably positioned in said housing;

a pressure-controlling piston slidably positioned in said transfer piston;

an energy-accumulating device controlling movement of said pressure-controlling piston within said transfer piston, said movement of said pressure-controlling piston providing an essentially uniform fluid pressure within said housing; and the camshaft applying pressure to said transfer piston thereby enabling passage of the lubricant from said pump to the variable valve timing device.

5. A piston pump, comprising a housing;

a transfer piston positioned within the housing, such piston being slidable within the housing in response to a force applied to a surface portion of the transfer piston;

a pressure-controlling piston slidably positioned with the transfer piston;

a fluid receiving chamber, a surface portion of the transfer piston providing a slidable first wall of such chamber;

a spring having one end thereof in engagement with the surface position of the transfer piston and an opposite end thereof in engagement with the surface portion of the pressure-controlling piston;

wherein the housing has a fluid entrance opening therein for receiving a fluid and wherein such pump includes a valve disposed between a second wall of the fluid receiving chamber and the opening for enabling fluid to enter the chamber or prevent fluid in the chamber for returning to the entrance opening selectively in accordance with force on the valve.

6. The pump recited in claim 7 wherein the housing has a fluid exit opening and wherein the chamber includes a passageway, and wherein the pump includes a valve disposed between the chamber and the fluid passageway.

7. The pump recited in claim 6 including a cam and wherein the cam provides the force to the transfer piston surface portion.

* * * * *